US007374588B2

(12) United States Patent
Williamson et al.

(10) Patent No.: US 7,374,588 B2
(45) Date of Patent: May 20, 2008

(54) FUEL COMBUSTION

(75) Inventors: Ian Vernon Williamson, Cheshire (GB); Clifford James Hazel, Cornwall (GB)

(73) Assignee: Interfacial Technologies (UK) Limited, Cheshire (GB)

( * ) Notice: Subject to any disclaimer, the term of this patent is extended or adjusted under 35 U.S.C. 154(b) by 355 days.

(21) Appl. No.: 10/450,551

(22) PCT Filed: May 2, 2001

(86) PCT No.: PCT/GB01/01931

§ 371 (c)(1),
(2), (4) Date: Jun. 12, 2003

(87) PCT Pub. No.: WO01/83649

PCT Pub. Date: Nov. 8, 2001

(65) Prior Publication Data

US 2004/0010964 A1 Jan. 22, 2004

(30) Foreign Application Priority Data

May 2, 2000 (GB) ..... 0010575.9

(51) Int. Cl.
*C10L 1/18* (2006.01)
*C10L 1/22* (2006.01)

(52) U.S. Cl. ..... 44/336; 44/301; 44/302; 44/385; 44/418; 44/420; 44/443

(58) Field of Classification Search ..... 44/301, 44/336, 385, 418, 420, 443, 302
See application file for complete search history.

(56) References Cited

U.S. PATENT DOCUMENTS

| | | | | |
|---|---|---|---|---|
| 4,166,724 | A | 9/1979 | Kanao | |
| 5,535,708 | A * | 7/1996 | Valentine | 123/25 C |
| 5,746,783 | A | 5/1998 | Compere et al. | |
| 5,813,224 | A * | 9/1998 | Rao et al. | 60/274 |
| 6,656,236 | B1 * | 12/2003 | Coleman et al. | 44/301 |

FOREIGN PATENT DOCUMENTS

| | | |
|---|---|---|
| EP | 0 560 567 A1 | 9/1993 |
| EP | 0 590 880 B1 | 4/1994 |
| GB | 2217229 A | 10/1989 |
| WO | WO 98/17745 A1 | 4/1998 |
| WO | WO 99/35215 A2 | 7/1999 |
| WO | WO 00/36055 A1 | 6/2000 |
| WO | WO 01/10982 A1 | 2/2001 |
| WO | WO 01/38464 A1 | 5/2001 |

* cited by examiner

*Primary Examiner*—Cephia D. Toomer
(74) *Attorney, Agent, or Firm*—Spencer Fane Britt & Browne LLP

(57) ABSTRACT

A stable, substantially clear and homogeneous fuel composition contains an additive comprising a nitrogen donor and carrier, the nitrogen donor being present in an amount sufficient to reduce the $NO_x$ emissions of the fuel when subject to combustion and the carrier being selected to render the nitrogen donor soluble and to give the additive a molecular weight compatible with the energy properties of the fuel.

21 Claims, No Drawings

FUEL COMBUSTION

The invention relates to a fuel composition. The fuel may be Diesel, gasoline, Kerosene; or the like.

The reduction of emission from burned fuel in combustion engines is fundamental to any progress in the automotive industry. Numerous proposals exist to address the problem. Various emulsions have been formulated to transport oxygenates to the point of combustion with different effects on performance. Particulate problems, particularly in Diesel engines, are being addressed by the addition of black smoke filters or catalytic converters.

U.S. Pat. No. 5,746,783 discloses the addition to fuel of an additive made up of urea or a triazine plus a mixture of butyl alcohol, water, oleic acid and ethanolamine forming a carrier. So far as we are aware this proposal has not achieved commercialisation, probably because the performance characteristics of the fuel not achieved, i.e. the intended power and energy properties are not realised by use of this additive.

It is an object of this invention to provide an additive which can be added to fuel to provide a clear stable fuel which can be passed to the point of combustion and will reduce NOx and particulates without compromise of the performance characteristics of the fuel.

According to the invention in one aspect there is provided a stable clear and substantially homogeneous fuel composition containing an additive comprising a nitrogen donor and a carrier, the nitrogen donor being present in an amount to reduce the NOx emissions of the fuel when subject to combustion and the carrier being selected to solubilise the nitrogen donor and to give the additive a molecular weight compatible with the energy properties of that fuel.

Preferably the nutrient donor is urea, cyanuric acid; isocyanic acid; a triazine; ammonia, an amide; or the like. Any one of these donors may do the task alone or a combination may be used; it is preferred to use an amide or a number of such amides.

Preferably the basic component of the carrier is a ethoxylated fatty acid having at least 12 carbon atoms. The fatty acid may be oleic, lauric, palmitic and stearic; preferably the ethoxylated fatty acid is oleic acid. While the degree of ethoxylation may vary say from 5 to 8, preferably there are seven molecules of ethoxy groups per molecule of fatty acid.

The molecular weight of the carrier ingredients will be selected according to the fuel. Preferably the molecular weight ranges from about 250 to about 600.

The amount of additive will depend on the fuel. Typically the rate of addition will be from about 2 to about 10 g per gallon (4.5 liter) of fuel for a Diesel; from about 1 to about 3 g per gallon (4.5 liter) of gasoline.

The amount of nitrogen donor in the additive will range from about 1 to about 5 grams by volume.

Other ingredients can be present in the fuel or the carrier for different effects. Nitrates may be present, such as ethyl hexylnitrate and ethyl octylnitrate. Polyethylene glycol and ethylene oxide may be present as stabilisers. Propylene oxide; iso-propanol; iso-butanol may be present to carry water. Oils such as olive oil or groundnut oil may be present. Amines may be present with fatty acids. Water may be present and the urea or other nitrogen donor may be dissolved in that first.

The fuel composition containing an additive of this invention is stable for normal periods of fuel storage. This is particularly important in the modern day automobile as the fuel line could have a return line to the fuel tank in which case it is not uncommon for 80% of the fuel to return to the fuel tank unused.

An advantage of this invention is the ability of the additive to provide a fuel having an exceptionally low Reid Vapour Pressure value without the need for major blending and ability to combust in an internal combustion engine and emit less NOx from the exhaust stream compared to that from a comparable untreated fuel.

The additive is to have a relatively heavy molecular weight for gasoline or a relatively lighter weight for 2-stroke gasoline, 2-stroke slow speed Diesel engines. The invention is applicable to any Diesel fuel, including marine Diesel, gasoline, kerosene or the like.

In another aspect the invention provides an additive for a fuel composition, the additive comprising a nitrogen donor and a carrier, the nitrogen donor being present in an amount to reduce NOx emissions of the fuel when subjected to combustion and the carrier being selected to solubilise the nitrogen donor in the fuel and give the additive a molecular weight compatible with the energy properties of that fuel.

In yet another aspect the invention provides a method of adding the additive to the fuel to form a stable clear homogeneous fuel.

In order that the invention may be well understood it will be described with reference to the following examples, which are given by way of illustration only.

EXAMPLE 1

Equal amounts of ethoxylated oleic acid with 7 mols of ethoxylation, was heated to above 45° C., crystals of urea (98.5%) were added and slowly dissolved into the fatty acid. A light fraction C5 to C12 hydrocarbon was then blended and the resultant mix was blended at a rate of 1 part of mix to 500 parts Diesel, i.e. at the rate of 3 g of urea per 4.5 liters of fuel. The result was a stable clear homogeneous fuel. The fuel remained stable at temperature fluctuations of −10° C. to 90° C.

EXAMPLE 2

Urea and water in a ratio of 1:1 were heated to above 40° C. to produce a clear solution, which was then added in a ratio of 1:1 to an ethoxylated fatty acid and added to a diethanolamide and a higher alcohol ethoxylate. The stable clear solution formed was added to Diesel at the rate of 1% and was temperature tolerant from −10° C. to 90° C.

EXAMPLE 3

A higher alcohol and urea (ratio 1:1) were mixed in water and heated until the urea was completely dissolved. The solution formed was added in a ratio of 1:1 to an ethanolamine having a high ammonia content and a fatty acid ethoxylate. The molecular weight of the formed additive was not less than 250. The additive was then blended into a reference gasoline and tested for RVP according to ASTM D323. The results in psi of Reid Vapour Pressure were as follows:

| | | |
|---|---|---|
| a) | reference gasoline (no additive) | 8.3 |
| b) | base gasoline + 2 ml of additive per litre | 8.1 |
| c) | base gasoline + 4 ml of additive per litre | 7.1 |
| d) | base gasoline + 6 ml of additive per litre | 7.1 |

EXAMPLE 4

Fuel prepared as in Example 1 was added to a Peugeot Diesel car and taken for an MOT opacity smoke test. The opacity readings or K values reduced by over 30% less compared to the treated fuel. According to calculations, particulate matter was also reduced.

It will be seen from these examples that the invention provides a low dose, high molecular weight additive, which, when added to a fuel, has the ability to minimise NOx of the complete exhaust stream. The resultant fuel also has a reduce Reid Vapour Pressure. Because the amount of additive is low the stoichiometric potential is not upset.

The invention is particularly applicable to combustion engines in vehicles when the fuel:air ratio tends to vary on a continuous basis. Our evaluations have established that additive can be used and the fuel will be burned with reduced emissions but without detriment to the power and torque produced.

The invention claimed is:

1. An additive for a fuel composition consisting of a carrier and a nitrogen donor, wherein the nitrogen donor is present in an amount to reduce $NO_x$ emissions of the fuel during combustion and is selected from the group consisting of urea, cyanuric acid, isocyanic acid, a triazine and ammonia, and wherein the carrier is selected from the group consisting of ethoxylated fatty acid and ethoxylated fatty acid in admixture with an ethanolamine.

2. The additive of claim 1, wherein the nitrogen donor is in solution.

3. The additive of claim 2, wherein the nitrogen donor is dissolved in a solvent selected from the group consisting of water, higher alcohol, and a mixture of water and higher alcohol.

4. The additive of claim 1, wherein the nitrogen donor is urea.

5. The additive of claim 4, wherein the urea is dissolved in a solvent selected from the group consisting of water, higher alcohol and a mixture of water and higher alcohol.

6. The additive of claim 1, wherein the carrier consists of ethoxylated fatty acid.

7. The additive of claim 6, wherein the ethoxylated fatty acid has at least 12 carbon atoms.

8. The additive of claim 7, wherein the ethoxylated fatty acid is oleic acid.

9. The additive of claim 6, wherein the ethoxylated fatty acid has seven ethoxy groups.

10. A stable, substantially clear and homogeneous fuel composition containing an additive as claimed in claim 1.

11. A method of making an additive for a fuel composition comprising steps of: (a) mixing a nitrogen donor and a carrier; and (b) heating the nitrogen donor and the carrier, wherein the nitrogen donor is present in an amount to reduce $NO_x$ emissions of the fuel during combustion and is selected from the group consisting of urea, cyanuric acid, isocyanic acid, a triazine and ammonia, and wherein the carrier is selected from the group consisting of ethoxylated fatty acid and ethoxylated fatty acid in admixture with an ethanolamine.

12. The method of claim 11, further comprising a step of dissolving the nitrogen donor in a solvent before said step (a).

13. The method of claim 12, wherein the solvent is selected from the group consisting of water, higher alcohol and a mixture of water and higher alcohol.

14. The method of claim 11, further comprising a step of blending the additive with fuel or a fuel composition.

15. The method of claim 14, wherein the fuel or fuel composition is selected from the group consisting of diesel fuel and gasoline.

16. The method of claim 14, wherein the nitrogen donor consists of urea and the carrier consists of ethoxylated oleic acid.

17. The method of claim 14, wherein the fuel composition is stable, substantially clear and homogeneous.

18. The method of claim 12, further comprising a step of blending the additive with fuel or a fuel composition.

19. The method of claim 18, wherein the fuel or fuel composition is selected from the group consisting of diesel fuel and gasoline.

20. The method of claim 18, wherein the nitrogen donor consists of urea and the carrier consists of ethoxylated oleic acid.

21. The method of claim 18, wherein the fuel composition is stable, substantially clear and homogeneous.

* * * * *